US009046854B2

(12) United States Patent
Yang et al.

(10) Patent No.: US 9,046,854 B2
(45) Date of Patent: Jun. 2, 2015

(54) ESTIMATING ACCURACY OF A REMAINING USEFUL LIFE PREDICTION MODEL FOR A CONSUMABLE USING STATISTICS BASED SEGMENTATION TECHNIQUE

(71) Applicant: XEROX CORPORATION, Norwalk, CT (US)

(72) Inventors: Ming Yang, Fairport, NY (US); Diane M. Foley, Palmyra, NY (US); William K. Stumbo, Fairport, NY (US); Juan Li, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 52 days.

(21) Appl. No.: 13/929,760

(22) Filed: Jun. 27, 2013

(65) Prior Publication Data

US 2015/0003847 A1 Jan. 1, 2015

(51) Int. Cl.
*G03G 15/08* (2006.01)
*G03G 15/00* (2006.01)

(52) U.S. Cl.
CPC ..... *G03G 15/556* (2013.01); *G03G 15/0856* (2013.01)

(58) Field of Classification Search
CPC ..... G03G 15/556; G03G 15/0831; G03G 15/0824; G03G 15/0863; G03G 15/0877
USPC ..... 399/27
See application file for complete search history.

(56) References Cited

U.S. PATENT DOCUMENTS

| | | | | |
|---|---|---|---|---|
| 5,225,873 | A | 7/1993 | Lux et al. | |
| 5,802,420 | A | 9/1998 | Garr et al. | |
| 6,584,291 | B1 | 6/2003 | Yamamoto | |
| 7,102,770 | B2 | 9/2006 | Wells et al. | |
| 7,146,114 | B2 | 12/2006 | Frankel et al. | |
| 7,649,638 | B2 | 1/2010 | Beard et al. | |
| 7,747,180 | B2 | 6/2010 | Wittenauer et al. | |
| 8,024,236 | B2 | 9/2011 | Vitulli et al. | |
| 2005/0084272 | A1* | 4/2005 | Kikuchi | 399/12 |
| 2007/0094220 | A1* | 4/2007 | McCaffrey | 706/52 |
| 2009/0092402 | A1 | 4/2009 | Mizuno | |
| 2011/0058184 | A1 | 3/2011 | Ramesh et al. | |
| 2012/0010902 | A1* | 1/2012 | Goldberg | 705/2 |
| 2012/0143564 | A1* | 6/2012 | Li et al. | 702/179 |

* cited by examiner

*Primary Examiner* — Walter L Lindsay, Jr.
*Assistant Examiner* — Frederick Wenderoth
(74) *Attorney, Agent, or Firm* — Ronald E. Prass, Jr.; Prass LLP

(57) ABSTRACT

An apparatus and method of predicting the end of life of a consumable. A basic weighted least squares algorithm has been extended and augmented to compensate for observed common consumable/printer behavior. The system uses consumable usage data (such as toner level) acquired from the device to predict the current and future consumable level and to predict the remaining life. The apparatus and method monitors the consumable's usage and updates the prediction so that when the predicted remaining life matches a preset threshold, it automatically triggers an order placement event to ship product to customer.

12 Claims, 13 Drawing Sheets

700

| PRINTER XXX, CARTRIDGE EXCHANGES 710 | | | +/-5 DAY ACCURACY % 770 | +/-10 DAY ACCURACY % 780 | +/-20 DAY ACCURACY % 790 |
|---|---|---|---|---|---|
| STANDARD LINEAR REGRESSION 750 | ALL | OVER ALL | 57.26 | 77.33 | 88.59 |
| | -1<=K<-0.8 | OVER ALL | 59.27 | 79.96 | 91.41 |
| | | $V_{ur}$<=10000 | 60.38 | 81.07 | 92.00 |
| | | $V_{ur}$>10000 | 46.67 | 67.33 | 84.67 |
| | K>=-0.8 | OVER ALL | 9.09 | 14.29 | 20.78 |
| | | $V_{ur}$<=10000 | 9.76 | 17.07 | 24.39 |
| | | $V_{ur}$>10000 | 8.33 | 11.11 | 16.67 |
| WEIGHTED LEAST SQUARE REGRESSION 760 | ALL | OVER ALL | 66.86 | 82.80 | 91.38 |
| | -1<=K<-0.8 | OVER ALL | 69.37 | 85.80 | 94.57 |
| | | $V_{ur}$<=10000 | 72.46 | 88.51 | 96.17 |
| | | $V_{ur}$>10000 | 31.85 | 52.87 | 75.16 |
| | K>=-0.8 | OVER ALL | 30.00 | 38.57 | 44.29 |
| | | $V_{ur}$<=10000 | 38.71 | 48.39 | 53.76 |
| | | $V_{ur}$>10000 | 12.77 | 19.15 | 25.53 |

720 730

FIG. 7A

700B

| PRINTER XXX, MAGENTA CARTRIDGE EXCHANGES | | | +/-5 DAY ACCURACY % | +/-10 DAY ACCURACY % | +/-20 DAY ACCURACY % |
|---|---|---|---|---|---|
| STANDARD LINEAR REGRESSION | ALL | OVER ALL | 54.94 | 74.18 | 87.35 |
| | -1<=K<-0.8 | OVER ALL | 56.76 | 76.72 | 90.08 |
| | | $V_{ur}$<=10000 | 57.13 | 77.51 | 90.74 |
| | | $V_{ur}$>10000 | 53.22 | 69.01 | 83.63 |
| | K>=-0.8 | OVER ALL | 12.66 | 15.19 | 24.05 |
| | | $V_{ur}$<=10000 | 14.89 | 19.15 | 29.79 |
| | | $V_{ur}$>10000 | 9.38 | 9.38 | 15.63 |
| WEIGHTED LEAST SQUARE REGRESSION | ALL | OVER ALL | 64.82 | 83.20 | 92.17 |
| | -1<=K<-0.8 | OVER ALL | 66.96 | 85.82 | 94.83 |
| | | $V_{ur}$<=10000 | 69.28 | 88.64 | 96.75 |
| | | $V_{ur}$>10000 | 42.37 | 55.93 | 74.58 |
| | K>=-0.8 | OVER ALL | 34.48 | 46.21 | 54.48 |
| | | $V_{ur}$<=10000 | 41.67 | 55.56 | 65.74 |
| | | $V_{ur}$>10000 | 13.51 | 18.92 | 21.62 |

FIG. 7B

ESTIMATING ACCURACY OF A REMAINING USEFUL LIFE PREDICTION MODEL FOR A CONSUMABLE USING STATISTICS BASED SEGMENTATION TECHNIQUE

CROSS REFERENCE TO RELATED PATENTS AND APPLICATIONS

This application is related to the following co-pending applications, which is hereby incorporated by reference in its entirety: "PREDICTING REMAINING USEFUL LIFE FOR A CONSUMABLE USING A WEIGHTED LEAST SQUARE REGRESSION PREDICTION TECHNIQUE", U.S. patent application Ser. No. 13/929,748, filed herewith, by Ming Yang et al.

BACKGROUND

Disclosed herein are methods and systems that use life histories to determine component life, and more particularly to systems that use weighted least square regression to create a predictor for the expiration of replaceable components.

In image formation processing in an image forming apparatus represented by a printer system or the like, print processing is performed by using print materials such as a photoreceptor, a toner, and the like. Because these materials are reduced or degraded according to the use thereof, they are consumable items which require maintenance. These consumables may be arranged as unit called a cartridge, and if intended for replacement by the customer or machine owner, may be referred to as a customer replaceable unit (CRU). Examples of a CRU may include printer cartridge, toner cartridge, transfer assembly unit, photo conductive imaging unit, transfer roller, fuser or drum oil unit, and the like. It may be desirable for a CRU design to vary over the course of time due to manufacturing changes or to solve post-launch problems with the machine, the CRU, or a CRU and machine interaction. It is known to provide the CRU with a monitoring device commonly referred to as a CRUM (Customer Replaceable Unit Monitor). A CRUM is typically associated with a memory device, such as a ROM, EEPROM, SRAM, and other suitable non-volatile memory device or data collecting network system, with processing capabilities provided in or on the cartridge. Information identifying the CRU may be written on the EEPROM during manufacture of the CRUM. The printer system or the like updates the information in the memory element or other data collection system with monitored data to monitor the status of the replaceable module at the machine, at an external facility, or at the CRU.

The toner level in such an image forming apparatus is critical, and users appreciate knowing how much material is available. This is known as the remaining useful life of a consumable. A user may be distressed when finding out that the printer ran out of ink or toner in the middle of a print job. If the user was able to determine in advance that the useful life was relatively low, the user could take some steps to either more accurately estimate the possibilities of printing an entire print job using the amount of toner remaining in the currently installed toner cartridge at the printer, or could first go to the printer and install a new cartridge or ask someone at the network administrative level to replace the toner cartridge. Since most of the printers in the field are under some kind of service contract, the service providers would like to know exactly when they should ship the next consumable to the customer to replace the one in use without interrupting the printing service. A common method in predicting the remaining useful life of a consumable is by usage of a simple least square linear regression method. The simple least square regression method is a statistical technique which models the relationship between a set of dependent/response variables and a set of independent/predictor variables like the number of usage days or number of pages that can be printed until the life of the consumable is extinguished. The simple linear regression technique works well when the behavior of the dependent variables is regular (the usage is pretty much stable) and the variation is minor. The daily usage of the consumables, such as the daily usage of toner on office printing devices, is, however, by no means regular; printing is bursty and unpredictable on a daily basis. These problems reduce the ability of simple linear regression techniques to accurately predict the remaining life of toner cartridges and other consumables. Alternative approaches such as decision trees and classifiers to determine whether or not the level of a consumable is within a pre-specified reorder range have high scalability and implementation costs.

Statistically, the accuracy of results from any prediction model for consumable remaining life may depend on quite a few parameters such as the mean and the standard deviation/variance of the predicted time when life of the consumables ends, and the correlation coefficients between the usage of the consumable and the output of the service where, how and what the dependence are may depend on the consumable and how the model is created.

SUMMARY

According to aspects of the embodiments, there is provided a system and methods to accurately estimate a consumable's (such as toner) level at any time during use and instruction embodied in a computer readable medium to rapidly detect and report anomalies in measurement that prevent accurate estimation of supply level or the remaining life of a consumable.

BRIEF DESCRIPTION OF THE DRAWINGS

FIG. 7A is a table showing consumables segmented into groups with statistically different levels of prediction accuracy for a first consumable cartridge in accordance to an embodiment;

FIG. 7B is a table showing consumables segmented into groups with statistically different levels of prediction accuracy for a second consumable cartridge in accordance to an embodiment;

DETAILED DESCRIPTION

Figure 1:
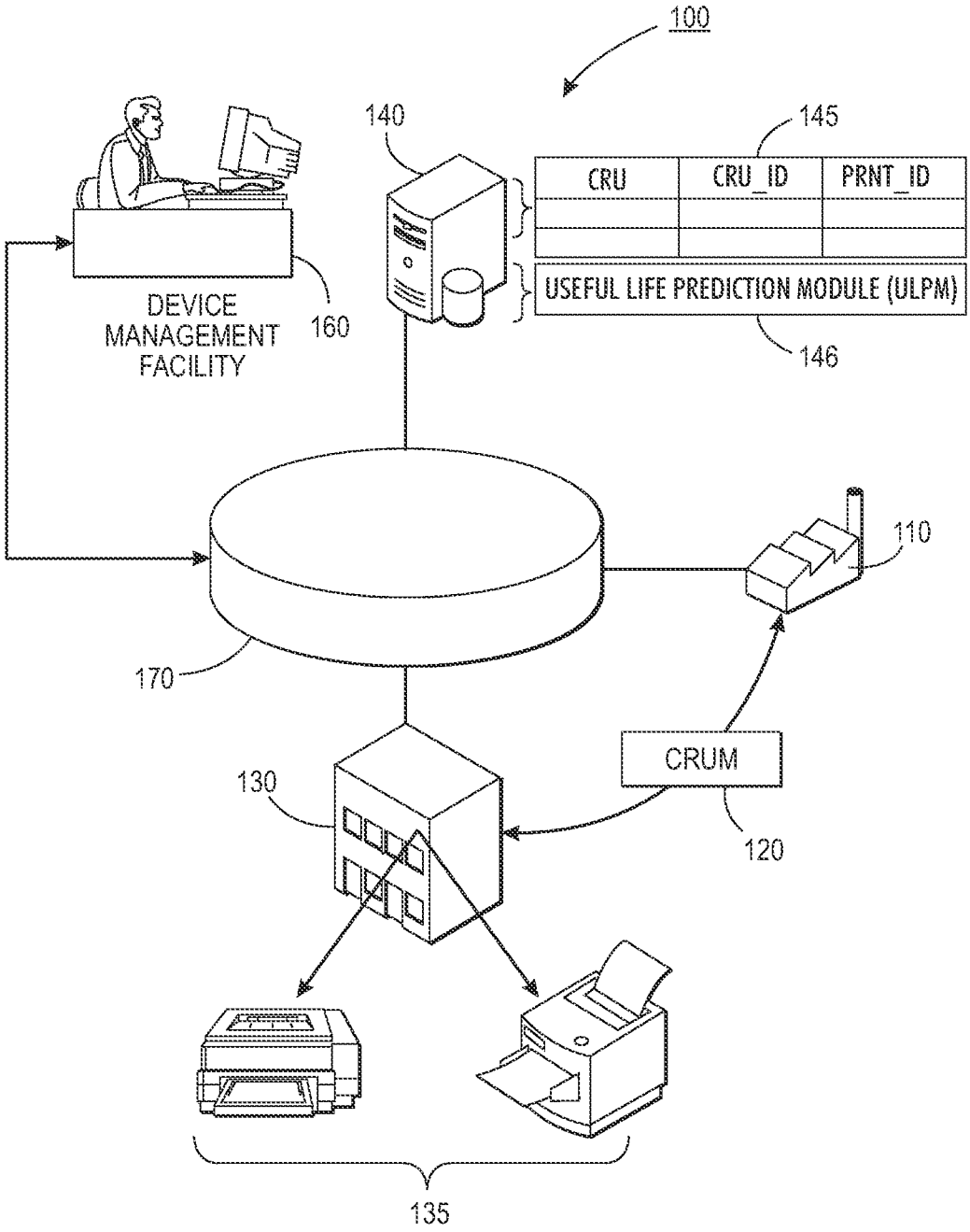
FIG. 1 is a block diagram of a network arrangement linking management application, supplier, and printer/copier device in accordance to an embodiment.

Aspects of the embodiments disclosed herein relate to methods based on a weighted least squares regression algorithm to predict the remaining useful life of consumables, such as toner cartridges on a printer/copier device, and corresponding apparatus and computer readable medium.

The disclosed embodiments include a method to rapidly detect anomalies in measurement and/or usage which would prevent accurate estimates of supply level and of remaining useful life of a consumable in an image reproduction device, the method comprises selectively segmenting consumables into groups which show statistically different levels of prediction accuracy by the features of the prediction models when a prediction was given by a prediction model applied to a historic consumable usage dataset; applying statistical metrics to the groups which show statistically different levels of prediction accuracy so as to alert a user or a service/maintenance provider when it is probable that a remaining life prediction models will not yield accurate results for a given time window, so that a different prediction model or an alternative shipment triggering algorithm can be employed.

The disclosed embodiments further include a non-transitory computer readable medium encoded with computer executable instructions, which when accessed, cause a machine to perform operations comprising selectively segmenting consumables into groups which show statistically different levels of prediction accuracy by the features of the prediction models when a prediction was given by a prediction model applied to a historic consumable usage dataset; applying statistical metrics to the groups which show statistically different levels of prediction accuracy so as to alert a user or a service/maintenance provider when it is probable that a remaining life prediction models will not yield accurate results for a given time window, so that a different prediction model or an alternative shipment triggering algorithm can be employed.

The disclosed embodiments further include a dynamic cloud based consumable management platform, comprising a database operable to store information associated with at least one replaceable toner cartridge, wherein the stored information includes daily toner cartridge level data from replaceable cartridges, wherein the database is further operable to rapidly detect anomalies in measurement and/or usage which would prevent accurate estimates of a remaining life of a replaceable cartridge and to alert a user or a service/maintenance provider that an anomaly has been detected by selectively segmenting replaceable toner cartridges into groups which show statistically different levels of prediction accuracy when a prediction was given by a prediction model applied to a historic replaceable toner cartridge usage dataset; applying statistical metrics to the groups which show statistically different levels of prediction accuracy to identify when it is probable that a remaining life prediction models will not yield accurate results for a given time window, so that a different prediction model or an alternative shipment triggering algorithm can be employed.

Systems, clients, servers, methods, and computer-readable media of varying scope are described herein. In addition to the aspects and advantages described in this summary, further aspects and advantages will become apparent by reference to the drawings and by reading the detailed description that follows.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of stations" may include two or more stations. The terms "first," "second," and the like, herein do not denote any order, quantity, or importance, but rather are used to distinguish one element from another. The terms "a" and "an" herein do not denote a limitation of quantity, but rather denote the presence of at least one of the referenced item.

As used herein, a historic consumable usage dataset is a collection of data pertaining to a consumable. A dataset enables portions of the data to be organized as records having values for respective fields (also called "attributes" or "columns") in a database system. The database system and stored datasets can take any of a variety of forms, such a sophisticated database management system or a file system storing simple flat files. One aspect of various database systems is the type of record structure it uses for records within a dataset (which can include the field structure used for fields within each record). In some systems, the record structure of a dataset may simply define individual text documents as records and the contents of the document represent values of one or more fields. In some systems, there is no requirement that all the records within a single dataset have the same structure (e.g., field structure).

The term "printing device" or "printing system" as used herein refers to a digital copier or printer, image printing machine, digital production press, document processing system, image reproduction machine, bookmaking machine, facsimile machine, multi-function machine, or the like and can include several marking engines, feed mechanism, scanning assembly as well as other print media processing units, such as paper feeders, finishers, and the like. "printing system" can handle sheets, webs, marking materials, and the like. A printing system can place marks on any surface, and the like and is any machine that reads marks on input sheets; or any combination of such machines.

The term "consumable" refers to anything that is used or consumed by a printing system during operations, such as print media, developer material, marking material, cleaning fluid, and the like. As used herein the terms consumable, customer replaceable unit (CRU), and customer replaceable unit monitor (CRUM) are used interchangeably to mean anything that is used or consumed by a printing system during operations.

The term "print media" generally refers to a usually flexible, sometimes curled, physical sheet of paper, plastic, or other suitable physical print media substrate for images, whether precut or web fed.

A "network management station" refers to a monitoring device or computer that monitors the status of a device/CRU on a computer network.

A "print management station" refers to a monitoring device or computer that is operated by a human user such as a system administrator (SA).

FIG. 1 is a block diagram of a network arrangement 100 linking management application, supplier, and printer/copier device in accordance to an embodiment.

The device management facility 160, database 140, supplier 110, and facility 130 including printing devices 135 include computers and means to exchange information between each entity or a subgroup in each entity. The computer describe in detailed in FIG. 2 can operate in a networked environment using logical connections to one or more remote computers, such as printing devices 135. These logical connections are achieved by a communication device coupled to, or a part of the computer. Embodiments are not limited to a particular type of communications device. A remote computer can be another computer, a server, a router, a network PC, a client, a peer device or other common network node. The logical connections depicted as network 170 include a local-area network (LAN) and a wide-area network (WAN). Such networking environments are commonplace in offices, enterprise-wide computer networks, intranets, extranets and the Internet.

In the network arrangement 100 a supplier 110 is a provider of consumables such as customer replaceable units (CRUs) that are used within printing devices like printing device 135 at facility 130. The customer replaceable units can comprise photoreceptors, fusers, drums, rollers, toner cartridges, ink cartridges, and the like. Customer replaceable units are items that are well-known to those ordinarily skilled in the art, and Details can be found, for example, in U.S. Pat. Nos. 7,146,112 and 7,529,491, the complete disclosures of which are incorporated herein by reference. The provided CRUs contain serial numbers within memories for easy CRUM identification like shown in CRUM 120 at FIG. 3. The supplier 110 maintains order information that is indicative of the target device that will be using the consumable such as CRUM 120. Such information can be combined or linked to form a dataset for easy tracking and monitoring. Further, when the CRU is returned to supplier 110 for replenishment (exchange), the CRUM ID of the CRU and the printing device it was installed is also available for storing and analysis by a management application service or the like. A facility 130 places an order for a consumable with supplier 110 or through other suitable retailer.

Information from an order is made available to database 140 where the information is combined with the historic consumable usage dataset to form data structure 145. The data structure contains time series data entries like usage data and the like for a plurality of printing devices and consumables. The time series data entries for a plurality of printing devices or CRUs may be stored in a single data structure or a collection of data structures. In addition, alternate data structures for storing similarity information will be apparent to those of ordinary skill in the art based on this disclosure. As a minimum data structure 145 comprises a printing device field indicative of where the CRU is to be installed or was installed, and usage data field indicative of consumption data. It should be noted that initially the data structures could have empty or null fields when the data is not known. It should be understood that fields could be grouped and arranged to include facilities, regions, type of devices such as printers and scanners, or any other possible grouping that includes CRUM ID and Printer ID. Additionally, database 140 has instructions to predict useful life of a consumable generally shown as a useful life prediction module (ULPM) 145.

Device management facility (DMF) 160 is a computer running a management application service that provides monitoring and replenishment capabilities to printing devices for which it has been assigned. The DMF gathers data from printers such as printing devices 135, database 140, and periodically polls the network print driver such as printing devices 135 at location 130 to ascertain the management information block (MIB) of the printing device. The DMF captures the consumables currently in the printing devices, status, and alerts (warning messages) currently maintained by the computer memory within the printing device. This information can be pulled or pushed to other hosted environment for additional processing across all other managed services accounts.

The printing device 135 usually include an interface or digital front end (DFE) that can comprise a scanner, a graphic user interface, network connections, a standard service interface, and/or other input output connections. Additionally, the printing device 135 has one or more controller like processor 230 that is operatively connected to a print engine. Controllers and printing devices are items that are well known to those ordinarily skilled in the art (for example, see U.S. Pat. No. 7,237,771 the complete disclosure of which is incorporated herein by reference) and are available from manufacturers such as Xerox Corp., Norwalk Conn., USA. Therefore, a detailed discussion of such items is not included herein so as to focus the reader on the main features of the disclosed embodiments.

Figure 2:
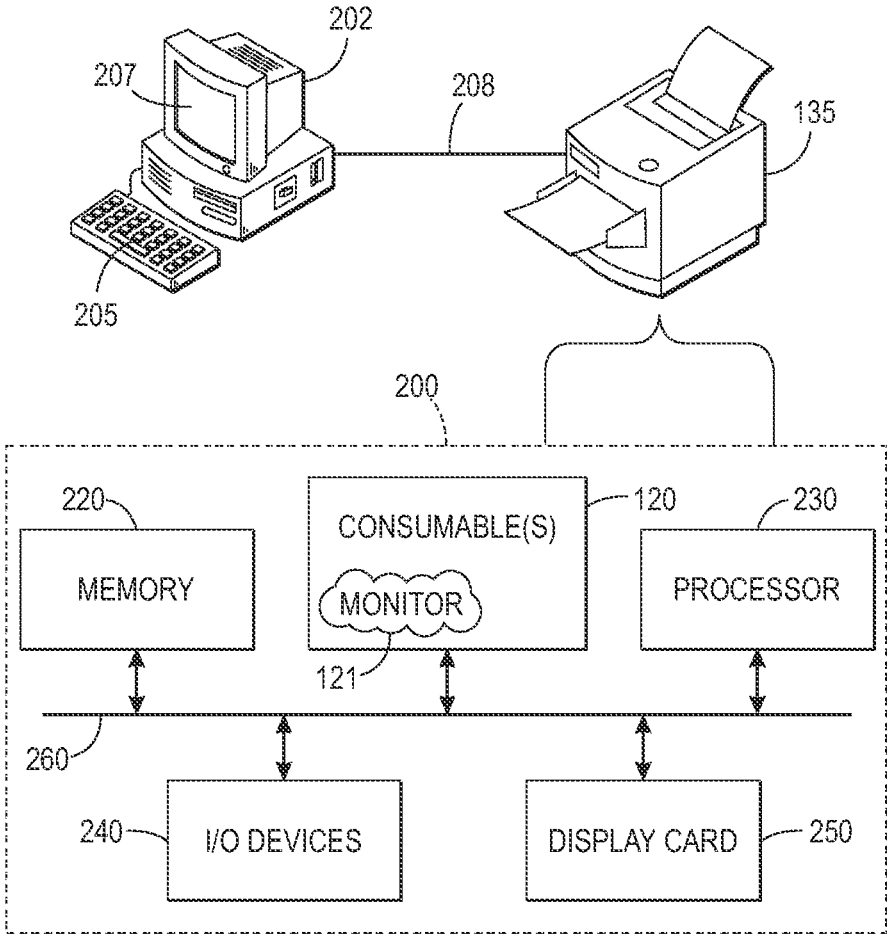
FIG. 2 is a simplified block diagram of an overview of a system 200 configured to implement an application management service for predicting the remaining useful life of a consumable in accordance to an embodiment.

In the preferred embodiment of the network arrangement 100, the device management facility (DMF) 160 can access the network 170 or the internet through a gateway to interact with the records in database 140, receive data from supplier 110, or poll printers in facility 130. In other embodiments, the device management facility (DMF) 160 can reside on an intranet, an extranet, a local area network ("LAN"), a wide area network ("WAN"), or any other type of network or stand-alone computer as shown in FIG. 2. If the DMF resides on a network, then the computer or terminal at DMF 160 is any machine or device capable of connecting to that network. The DMF can be linked to the database, supplier, or printing devices by fiber optic cable, wireless system, by a gateway, by a network, or a combination of these linking devices. Device management facility (DFT) 160 and database 140 can be maintained at the same facility and can be components of a computer. Since DFT 160 will be performing centralized help desk system or device management system functions it would be better to maintain the information regarding orders and target device information at the device management facility to insure data integrity.

FIG. 2 is a simplified block diagram of an overview of a system 200 configured to implement an application management service for predicting the remaining useful life of a consumable in accordance to an embodiment.

The system 200 may be embodied within devices such as a printer device 135, a desktop computer 202, a laptop computer, a server, a database system like database 140, a handheld computer, a handheld communication device, or another type of computing or electronic device, or the like. The system 200 may include a memory 220, a processor 230, input/output devices 240, a display card 250 and a bus 260. The bus 260 may permit communication and transfer of signals among the components of the computing device such as computer 202 or printer device 135.

Processor 230 may include at least one conventional processor or microprocessor that interprets and executes instructions. The processor 230 may be a general purpose processor or a special purpose integrated circuit, such as an ASIC, and may include more than one processor section. Additionally, the system 200 may include a plurality of processors 230.

Memory 220 may be a random access memory (RAM) or another type of dynamic storage device that stores information and instructions for execution by processor 230. Memory 220 may also include a read-only memory (ROM) which may include a conventional ROM device or another type of static storage device that stores static information and instructions for processor 230. The memory 220 may be any memory device that stores data for use by system 210.

Input/output devices 240 (I/O devices) may include one or more conventional input mechanisms that permit a user to input information to the system 200, such as a microphone, touchpad, keypad 205, keyboard, mouse, pen, stylus, voice recognition device, buttons, and the like, and output mechanisms such as one or more conventional mechanisms that output information to the user, including a display 207, one or more speakers, a storage medium, such as a memory, magnetic or optical disk, disk drive, a printer device, and the like, and/or interfaces for the above. The display 207 may typically be an LCD or CRT display as used on many conventional computing devices, or any other type of display device.

Consumable(s) 120 include monitoring devices 121 located either on the print device 135 or on the consumable 120 itself. The monitoring devices 121 monitors the consumable, for example, toner (i.e., marking agent) supply levels within consumables 120 or historical usage of the consumable over a specific variable like time or number of copies. Monitoring devices 121 are sometimes antenna sensor devices (i.e., coils), piezoelectric sensor, optical sensor, or a permeability sensor that measure supply levels within a cartridge. When using coils a current induces voltage signals within the cartridge that are proportional to the amount of toner present in the cartridge.

The system 200 may perform functions in response to processor 230 by executing sequences of instructions or instruction sets contained in a computer-readable medium, such as, for example, memory 220. Such instructions may be read into memory 220 from another computer-readable medium, such as a storage device, or from a separate device via a communication interface, or may be downloaded from an external source such as the Internet. The system 200 may be a stand-alone system, such as a personal computer, or may be connected to a network such as an intranet, the Internet, and the like.

The memory 220 may store instructions that may be executed by the processor to perform various functions. For example, the memory may store instructions to allow the system to perform various printing functions in association with a particular printer connected to the system. For example, the memory may store weighted least square regression based algorithms, useful life prediction models or modules, algorithms to apply knowledge gained from the historic data (dataset) during the development and validation of any prediction model to identify consumable/exchanges that will likely be predicted inaccurately, or any other statistical metric that can aid in the validation of prediction models.

The system 200 may have an n associated print engine connected thereto for printing data such as images, text, and the like. In response to a user directing the computer 202 to print, for example. In response to such a print command, the processor 230 will typically cause the processing system to communicate 208 with the printer to perform the needed printing. When exchanging data between the management application service and other devices such as database 140 or printing devices 135, the computer running the management application service is considered the second computer while the other device is considered the first computer. As shown the first computer in printing device 135 communicate with a second computer 202 through a communication link 208.

Figure 3:
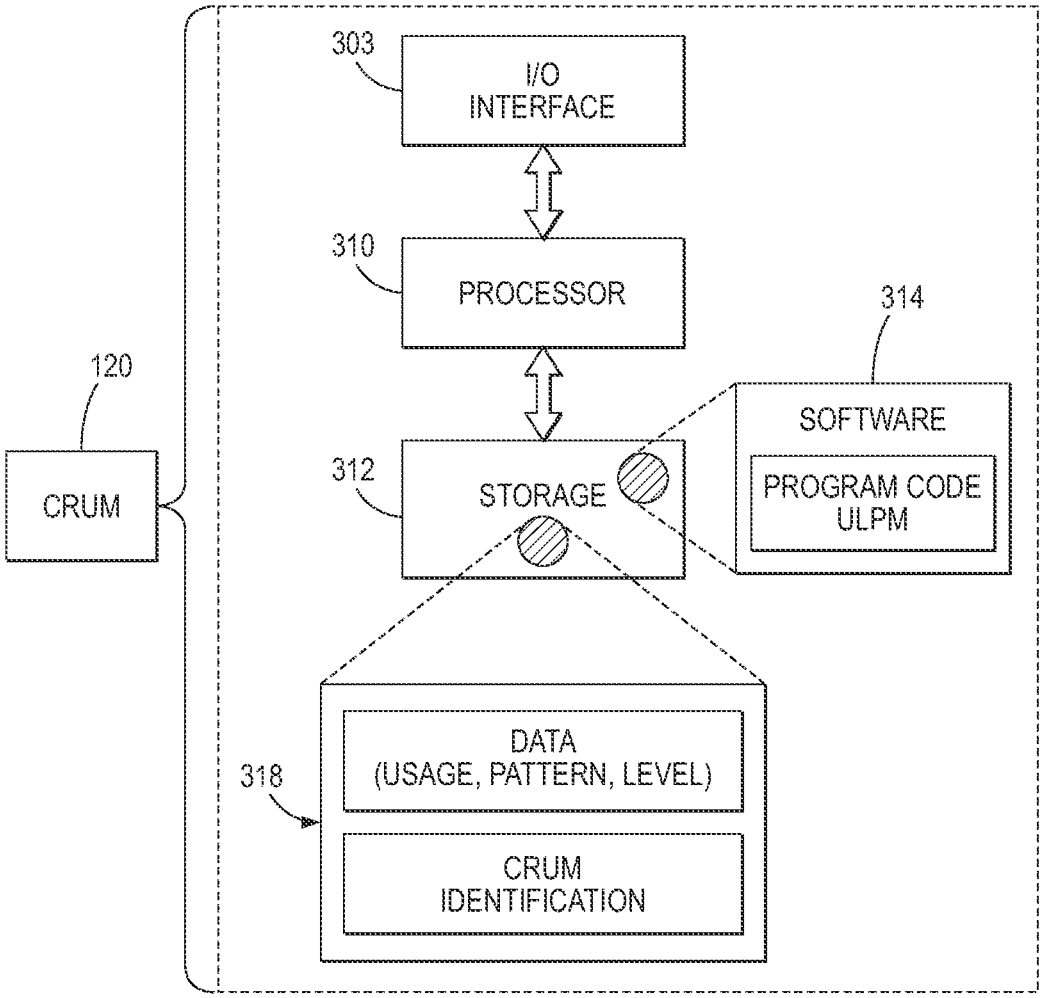
FIG. 3 is an illustration of the hardware and operating environment in a consumer replaceable unit monitor (CRUM) in accordance to an embodiment.

FIG. 3 is an illustration of the hardware and operating environment in a consumer replaceable unit monitor (CRUM) in accordance to an embodiment. The CRUM 120 has an input/output (I/O) interface 303 for exchanging data with the various controllers in a printing system or with a management application service such as described in FIG. 1. CRUM 120 has a processor for gathering data and for controlling operations in the printing environment. CRUM 120 has a processor 310 for performing control and monitoring functions after compiling software 314 in storage device 312. The operating system of the processor 310 can be different than the OS of the controller at the printing system or processor 230. Software component 314 may have executables or program code for causing the processor 310 to perform data gathering, controlling, and predicting the remaining useful life of the consumable. The CRUM ID may be generated at the factory and recorded on the CRUM at memory unit 318. Memory unit 318 can include one or more cache, ROM, PROM, EPROM, EEPROM, flash, SRAM or other devices; however, the memory is not limited thereto. The CRUM ID can be a unique identifier assigned to chip in CRU, a serial number assigned at the factory, a random number assigned at the factory, a media access control address, key code element string, a validation code determined in situ or assigned by an external source, a market designator code, additional identification or manufacturing information, any other code that differentiates product type, manufacturer, or the like. The content of storage 312, especially CRUM ID and program code, is hidden from potential piracy by being stored in a secure area. This helps to prevent a potential pirate from determining or changing the CRUM ID. The same protection is afforded to the algorithm, data, and execution sequences at the printing system or data management service.

Figure 4:
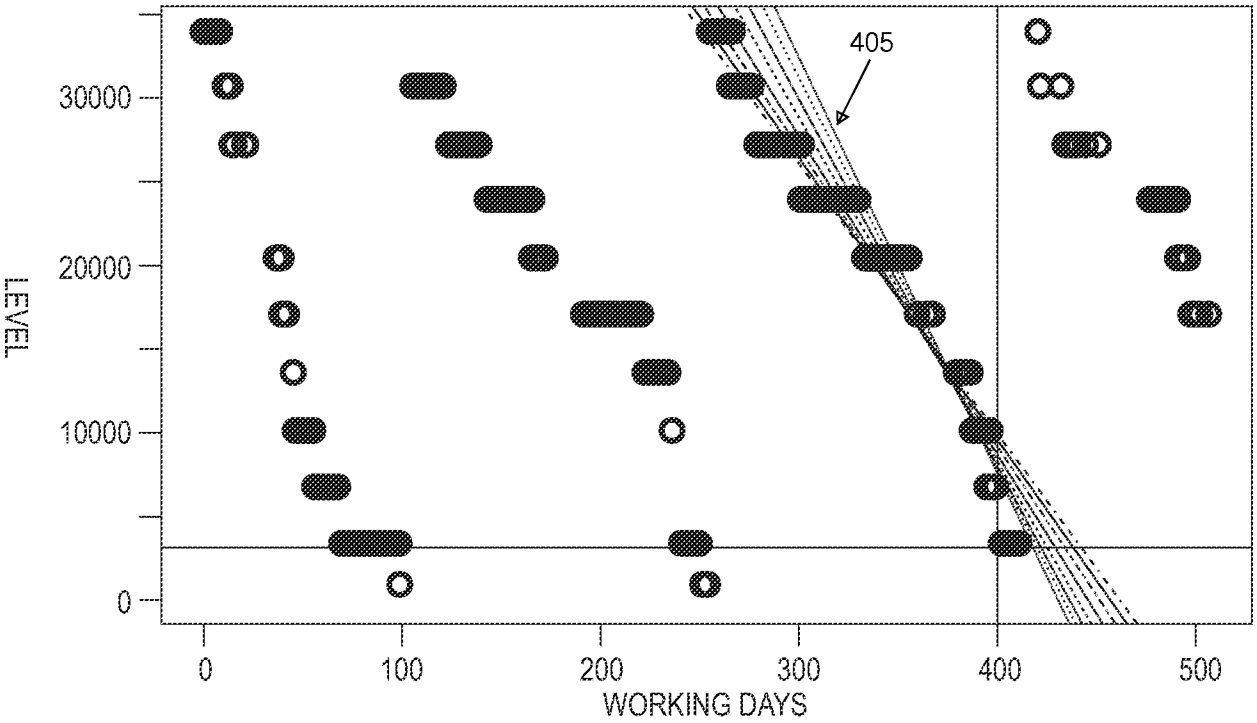
FIG. 4 is a toner consumption curve showing toner level and consumption days in accordance to an embodiment.

FIG. 4 is a toner consumption curve showing toner level and consumption days in accordance to an embodiment. FIG. 4 shows a model validation test where the prediction results are shown against the historical consumption data; it shows results of the weighted least square regression based model where the different lines 405 in the figure represent the results when the exponent N in the time dependent weight changes as shown in equation 3 (below). In this figure, the data point where working days (400) intercepts toner level is the prediction target 410 shown in FIG. 5. In varying embodiments the aim is to accurately predict when the toner level will hit the target or to provide notification when a prediction model needs to be replaced or change because of prediction accuracy are at least one standard deviation from the norm. As can be seen from the illustration the prediction errors vary as the exponent N varies and therefore one should be able to use historical data from devices of an adequate population to find the best exponent N to maximize the prediction accuracy over the consumable population of interest for a prediction model such as the weighted least squares regression outlined below.

Figure 5:
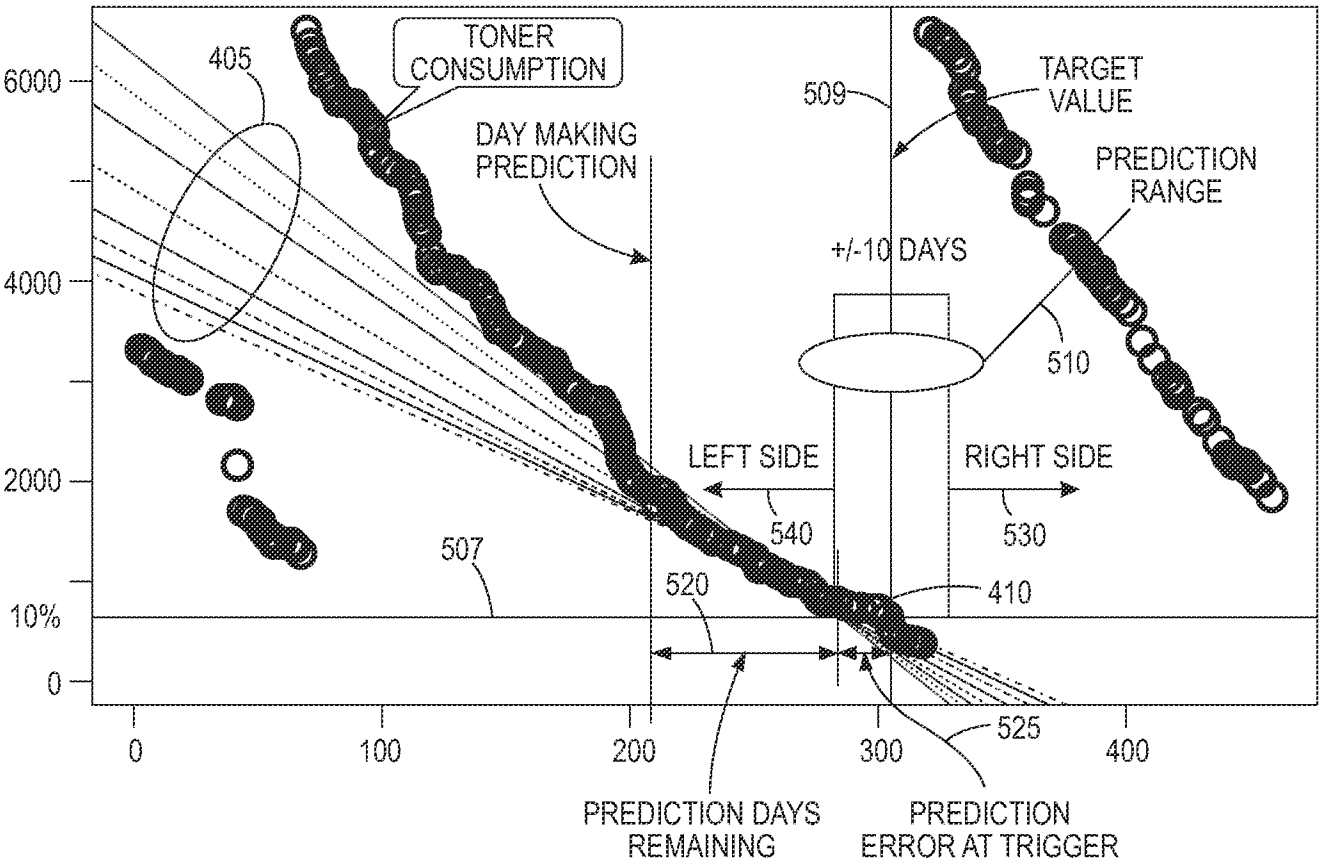
FIG. 5 shows prediction model validation from historic toner usage data in accordance to an embodiment.

FIG. 5 illustrates prediction model validation from historic toner usage data in accordance to an embodiment. FIG. 5 shows a toner consumption curve as well as how the consumption data can be used in validating a prediction model such as a weighted least square regression model. Usually, the prediction is updated daily and as soon as the predicted days of remaining life reaches a preset "prediction days remaining" trigger 520 the reorder is triggered. The model's accuracy is validated by finding out the prediction error 525 against the historic data at the trigger point 410. The prediction error is defined as the difference between the day when the toner reaches a target level which coincides with day 509 and a toner level 507 on the day-toner axis of FIG. 5, according to the model, and the actual day when the cartridge comes to the same target level. Depending on the type of printing devices, engineers commonly give a window (such as +/−10 days) like a prediction range 510 as an acceptable range for the prediction error and use the percentage of exchanges within the window as a measurement of the goodness of a prediction algorithm. As can be seen there will be predictions that will be on the left side 540 and on the right side 530 of the prediction range 510. Cartridges that fall on the left side of the prediction range 510 are being replaced too soon, while cartridges that are on the right side 530 are probably going empty during the printing cycle which tend to lower printing quality and lower customer satisfaction.

Figure 6A:
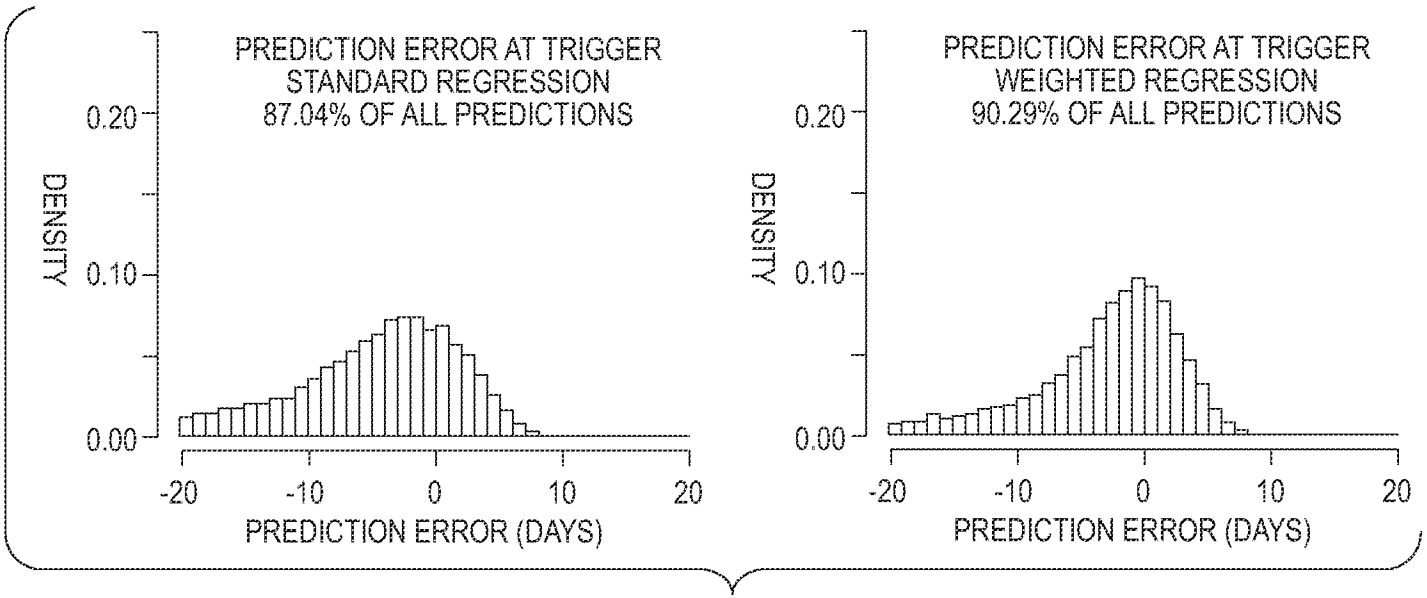
FIG. 6A shows prediction accuracy for standard and weighted prediction models for a first printer in accordance to an embodiment.
Figure 6B:
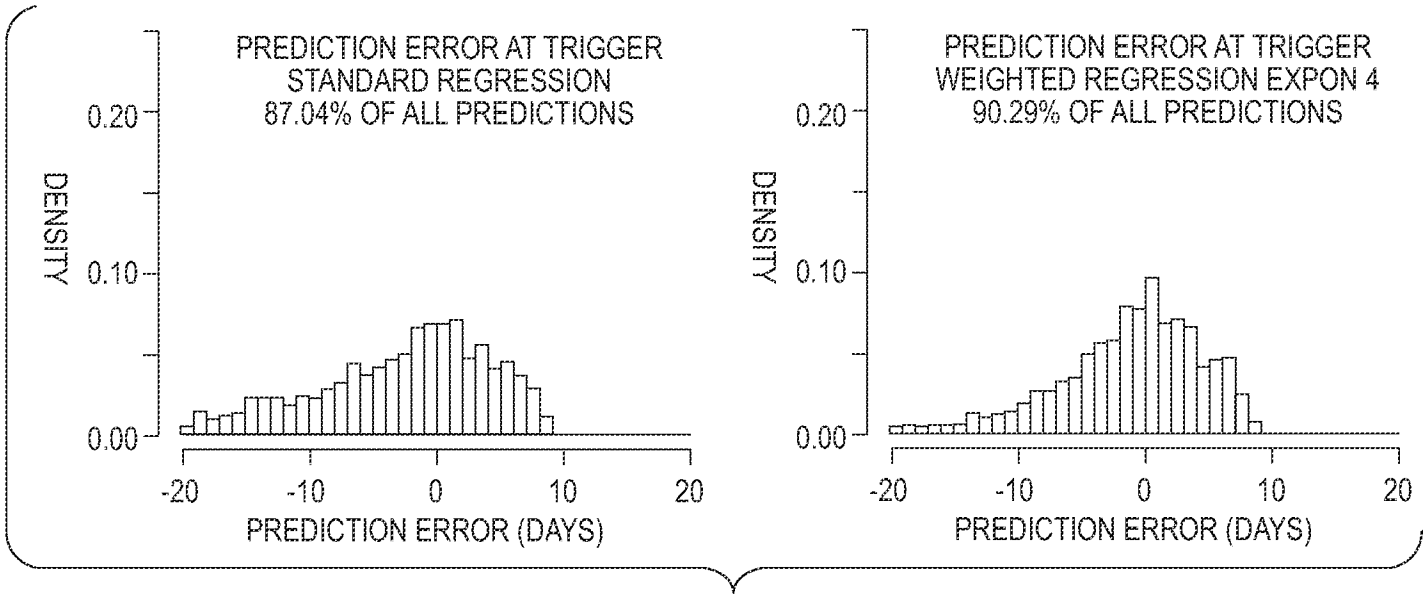
FIG. 6B shows prediction accuracy for standard and weighted prediction models for a second printer in accordance to an embodiment

FIGS. 6A and 6B show prediction accuracy for standard and weighted prediction models for a first and second printer in accordance to an embodiment. FIG. 6A illustrates the prediction accuracy plot using a standard linear regression algorithm and a weighted least regression algorithm prediction models for a first printer like the Xerox Corporation iGen3® or iGen4® digital printers. FIG. 6B is the prediction error for the standard and weighted regression on a second printer. As can be seen from these four set of plots (FIG. 6A and FIG. 6B), all prediction algorithms will produce prediction errors. The difference is only in the degree of error, i.e. the percentage of exchanges within the acceptable window that the algorithm produces. From the figure, the standard linear regression algorithm yielded remaining life predictions within the +/−20 day window with 87% accuracy for a first type image forming device like scanners and printers and 86% accuracy for another type of imaging device such as printer and the like, while the weighted least square regression algorithm produced remaining life predictions with 90% accuracy for the first type of imaging device machines and 93% accuracy for the other imaging device. That is to say that there are 7~14% of the cartridge exchanges which will have a remaining life predictions outside the +/−20 day window. In an embodiment a pre-segmentation method is proposed to select those exchanges where the prediction algorithms will more likely yield an inaccurate prediction so that the users of the prediction model can be alerted and better service can be achieved.

FIG. 7A is a table 700 showing consumables segmented into groups with statistically different levels of prediction accuracy for a first consumable cartridge in accordance to an embodiment. FIG. 7A shows a table for Cyan Cartridge Exchanges with pre-segmentation using an algorithm that applies knowledge gained from the historic data during the development and validation of any prediction algorithm to identify consumable/exchanges that will likely be predicted inaccurately. The table shows that by examining consumable/exchanges that were not predicted correctly one is able to identify a set of statistics that have a high degree of accuracy in identifying whether an exchange will be correctly predicted or not. By using these metrics during the operational phase of automatic supplies replenishment, one can reduce the number of incorrectly predicted toner exchanges, therefore reducing the number of stock outs or rush shipments that occur. Group 710 shows all the consumables and their predictions for different accuracies. The pre-segmented separates the population of toner exchanges using combinations of multiple parameters such as: (a) a group of a first moment and the standard deviation of the predicted time when the toner cartridge reaches end of life; (b) a group 730 of the mean and the standard deviation or variance ($V_{ur}$) of the usage rate of the consumable; and, (c) a group 720 of the correlation coefficients (K) between the usage of the consumable and the output of the service (i.e. toner level and impression count for printers). The +/−5 days prediction is shown in column 770, the +/−10 day prediction is shown in column 780, and the +/−20 prediction is shown in column 790. Two prediction models are compared. The standard linear regression model 750 and a weighted least square regression model 760. From the table the following observations are illustrated the correlation coefficient (K) between the daily toner level of the cartridge and the impressions made from the beginning of the exchange is a good indicator of the prediction model's accuracy. Regardless what color the cartridge is, the better the correlation, i.e. value approaches 1, and the better the prediction accuracy. Another useful indicator for prediction accuracy is the variance of the toner usage rate. A large variance in the toner usage rate is usually a sign that the prediction model may produce a poor remaining life prediction. A combination of a large variance of the toner usage rate and poor correlation between the daily toner level of the cartridge and the impressions made from the beginning of the exchange is a very strong indicator that both the standard linear regression and the weighted least square regression prediction models will fail to give an acceptable prediction. FIG. 7B is a table 700B showing consumables segmented into groups with statistically different levels of prediction accuracy for a second consumable cartridge (Magenta Cartridge) in accordance to an embodiment.

Figure 8:
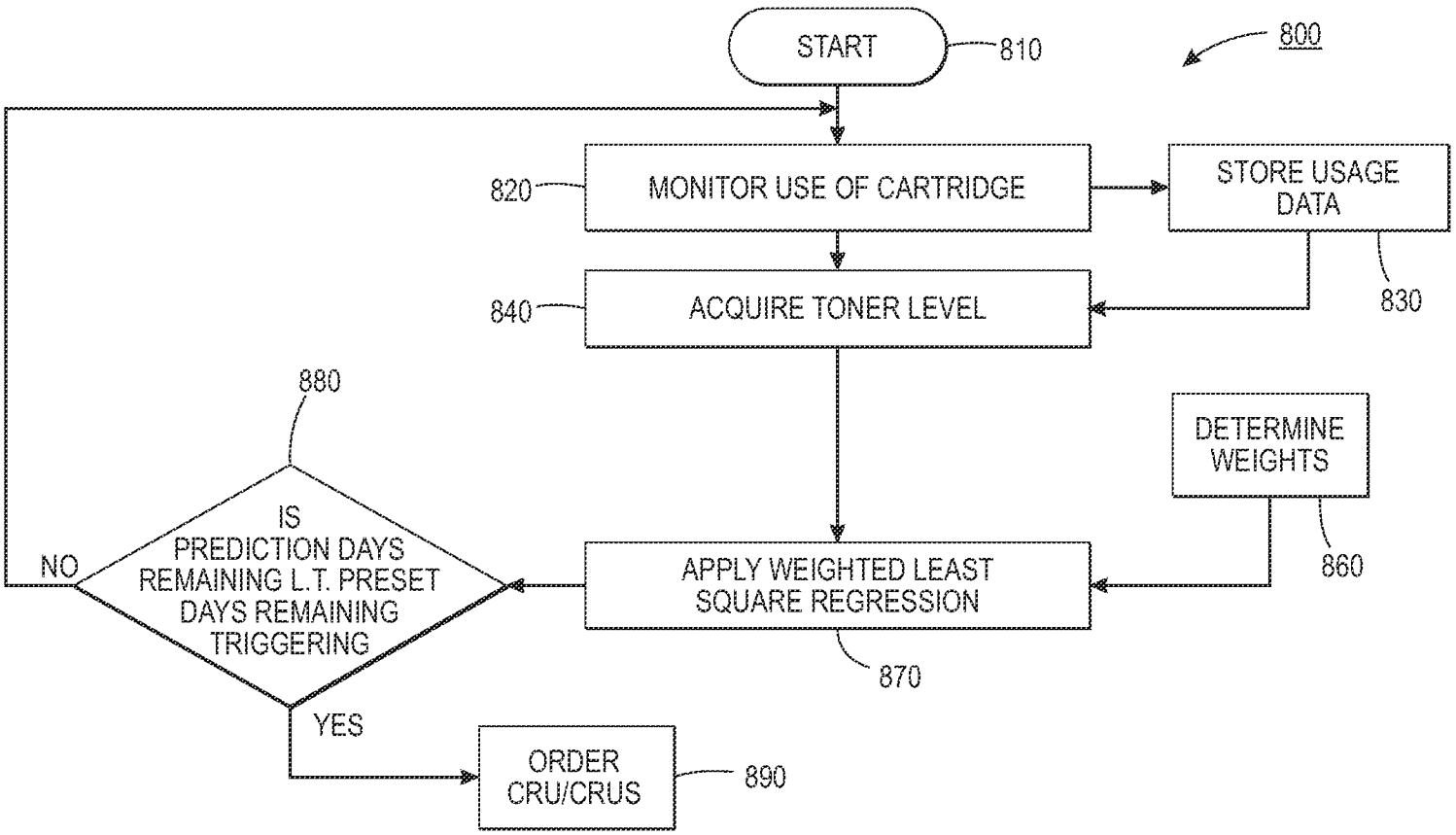
FIG. 8 is a flowchart of a method for predicting the useful life of a consumable using weighted least square regression in accordance to an embodiment.

FIG. 8 is a flowchart of a method for predicting the useful life of a consumable using weighted least square regression in accordance to an embodiment. Method 800 could be performed at the consumable such as CRUM 120, at the printing system such printer 135, at centralized locations or by external service such as device management facility 160, database 140, or cloud computing device. Method 800 begins with action 810, in action 810 is a start action initiates the process to start a prediction model. Control is passed to action 820 where the replaceable cartridge (consumable) is monitored at every use to ascertain how much of the consumable has been reduced or degraded. Data from monitor device 121 can be used to ascertain cartridge usage. The data from action 820 is then passed to action 830, store usage data, and action 840, which is acquire toner level. The store usage data, action 830, is processed and made part of the historic consumable usage dataset. In action 840, the usage data or the stored usage data is used to acquire the toner level for the consumable. This acquisition can be as simple as receiving a toner level signal from monitor device or it can be derived from calculations of the current usage data (action 820) and the capacity of the consumable at the time it is placed at the printing system. After acquiring the toner level in action 840 control is then passed to action 870 where the acquired toner level is modeled using weighted least square estimation and the model can then be used to predict the current toner level, future toner level, and/or to predict the remaining useful life of the consumable. The weights for the least square estimation are dynamically adjusted, at action 860, based on such factors as toner usage over time, measurement resolution error, and influence of multiple measurements over one measurement time unit as described in method 900 at FIG. 9. Concerning action 880, if a segmentation is used, the accuracy of the prediction model may be estimated based on historic results of such model of similar features when the accuracy is estimated to be low. In action 880, the predicted days remaining is compared with the days remaining triggering threshold, if the predicted days remaining is less than the preset days remaining triggering, an consumable shipping order should be triggered and control is passed to action 890 where an appropriate message is generated such as order more consumables (CRU/CRUs). The message and/or the shipping order are sent to a user of the printing system, to the fleet management service such as the fleet management facility 160, or to vested recipients of the status of the remaining useful life of a consumable. If in action 880 it is determined that the remaining useful life is greater than a predetermined value then control is passed to action 820 for further processing, i.e., monitor the consumable without generating a message.

Figure 9:
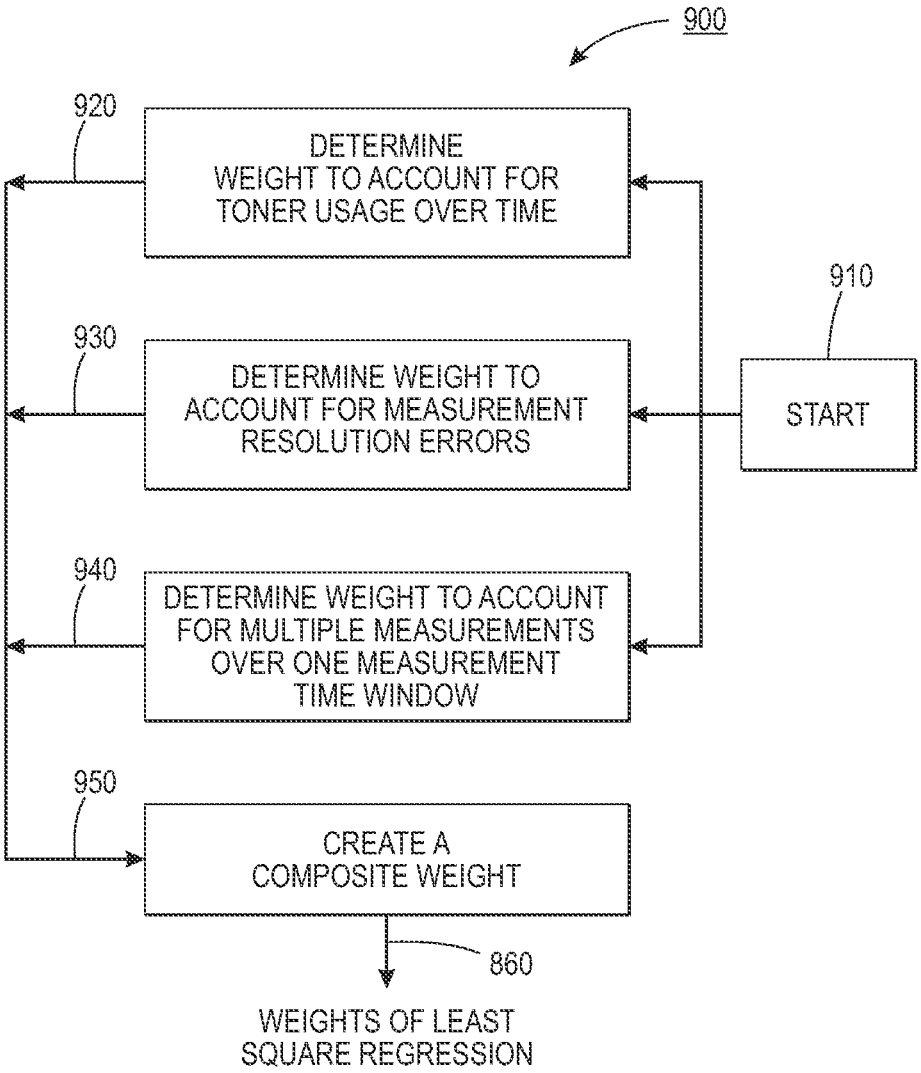
FIG. 9 is a flowchart of a method for determining weights for the regression method of FIG. 8 in accordance to an embodiment.

FIG. 9 is a flowchart of method 900 for determining weights for the regression method outlined in FIG. 8 in accordance to an embodiment. The weights generated at action 860, used by the weighted least square regression (actions 870), are generally determined by following actions 910-950. Action 910, starts the method and determinations modules 920-940 are prompted to generate a weight function comprising multiple layers. The layers are then assembled in action 950 which forms part of the weights of the weighted least square regression/estimation which when applied to a consumable like toner level changes can predict the remaining useful life of the replaceable cartridge. In action 920, a first weight is determined to account for toner usage over time. In action 930, a second weight is determined to account for measurement resolutions errors. In action 940, a third weight is determined to account for multiple measurements over one measurement time window. These determined weights are then combined into a weighting factor to significantly improve the ability of the least square regression to fit the data to predict the remaining life of the consumable like the observed toner levels of a cartridge.

A common method in predicting the remaining useful life of a consumable is by usage of a simple least square linear regression method. The simple least square regression method is a statistical technique which models the relationship between a set of dependent/response variables (toner level, for example) and a set of independent/predictor variables (number of usage days, for example). Simple linear (least squares) regression finds a linear regression relationship between these two sets of variables assuming that the error in the prediction is normally distributed. The simple linear regression technique works well when the behavior of the dependent variables is regular (the usage is pretty much stable) and the variation is minor. The daily usage of the consumables, such as the daily usage of toner on office printing devices, is, however, by no means regular; printing is bursty and unpredictable on a daily basis. These problems reduce the ability of simple linear regression techniques to accurately predict the remaining life of toner cartridges and other consumables.

Action 870 applies a weighted least square regression as a consumable life prediction method to overcome the limitations of simple regression. The general weighted least squares regression algorithm is to minimize the sum of the squares of the weighted residual errors, i.e., the difference between the measurement and the predicted value. Equation 1 is the basic mathematic equation of a weighted least-squares regression in its linear formation, which computes the values a and b so as to minimize the value $X^2$ (a, b) in the equation:

$$\chi^2(a, b) = \sum_{i=1}^{n} w_i(y_i - a - bx_i)^2 \qquad \text{EQ. 1}$$

Where $y_i$ is the experimental report value (toner level), $x_i$ is the independent variable (number of usage days), $w_i$ is the weight (Method 900) associated with the ith experiment and a and b are the coefficients of the fitted linear line. When $w_i$ is any non-zero constant across all the experiments, the weighted least squares regression method reduces to a simple least square regression method. Observations of the usage patterns (historical dataset in database 140) of a population toner cartridge exchanges showed that the rate of usage is not always constant. There are often irregular periods of high consumption or low consumption.

Therefore, equation 1 (EQ. 1) is directly applicable to predicting the remaining life of consumables and to find the current and future toner level according to the prediction formula, assuming $y_i$ as some kind of remaining level measurement of the consumable and $x_i$ as the time the consumables are in service. We want weight $w_1$ to be unevenly distributed across the experiments making some residual errors, i.e., the difference between a predicted value and an observed value, more critical than others. The objective of the optimization/minimization procedure in the weighted least square regression (action 870) is to discriminate and fit the curve to the experimental results, better at some places where the weight is bigger than at others where the weight is smaller. For prediction on remaining life of consumables, such as the toner cartridges in a printer, the errors between the predictions and the experiments/measurements at the latter stage of the toner life are found to be more critical than at the early stage of the toner life, so the weight should be bigger at a late stage than at an early stage.

The reported value (consumable level like toner usage) of a consumable is driven by many factors. First, and foremost, is the length of time the consumable has been in service. Other factors, such as the differences between the acquired measurement data on the consumables to their true values and measurement resolution and the like needs to be reflected in the weight function used in the predictive model. Such factors can be accounted for by layering the weights or dividing the weight function into multiple layers to create the final weight function as like in the following manner:

$$w_i = w_{0i} w_{1i} \ldots w_{Ki} f(x_i) \qquad \text{EQ. 2}$$

Where $w_{0i}, w_{1i} \ldots w_{Ki}$ are some weight component layers that account for different factors affecting the prediction model's accuracy and f(xi) is the time dependent weight layer to account for the time effect of the reported consumable level on the prediction accuracy. Although different forms of the time dependent weight may be used, one particular form of the time dependent weight can be:

$$f(x_i) = (x_i - x_0 + 1)^N \qquad \text{EQ. 3}$$

Where $x_i$ is a working time instance when the consumable reported its levels, $x_0$ is the time when the new consumable is installed and N is an exponent parameter which is determined by model validation for example from historic data.

It is quite common that some components of the measurement system lack adequate resolution leading to a dataset with poor granularity. For example, the toner consumption curve is shown in FIG. 4 shows that even though the printer is used every working day, the reported measured levels stay at the same level (stretched cylindrical) for multiple days due to the lack of resolution. One component layer of the weight function $w_{k0}$, in equation two (EQ. 2) is used to handle these kinds of issues: clustering the same level of measured data into one data point and using the number of times the values repeat as the value of this component layer in the weight function.

It is also not uncommon for the measurement system to report consumable levels multiple times over a single day and only once on other days. In this case, one of the component layers of the weights may be used to normalize the model, i.e. one may develop the prediction model based on one measurement per day and for the multiple reported measurements, we may use a fraction value as one of the component layers of the weights so that the contribution from each day is uniform within the model.

Another observation of office printing behavior shows that a printer is generally idle on some days. Across our sample population of devices it was found that the average device did not print on twenty five percent (25%) of the available days. In order to enhance our prediction accuracy, one option is to define the predictor variable x, i.e. the number of usage days, as the "working days", where the non-working days are not counted. One method to find out the non-working days is to use the reported value from the impression counter. Using the impression count to determine nonworking days gives better accuracy than simply classifying weekend days as nonworking days.

The weighted least square regression method provides a way of identifying instances where the data is too noisy to provide an accurate prediction. The slope of the fitted line generated by this embodiment represents the consumable's daily consumption, the slope and/or the end of life day calculated using the daily consumption slope provides a good signal. During normal operation, the end of life day predicted by the model should be relative stable, and the slope is always negative, meaning the consumable is diminishing over time. If the variation of the slope and/or the variation of the end of life day become too big it signifies that an unexpected event, being it measurement error, connectivity error or data acquisition error, has occurred and flags the device for inspection or closer observation.

Figure 10:
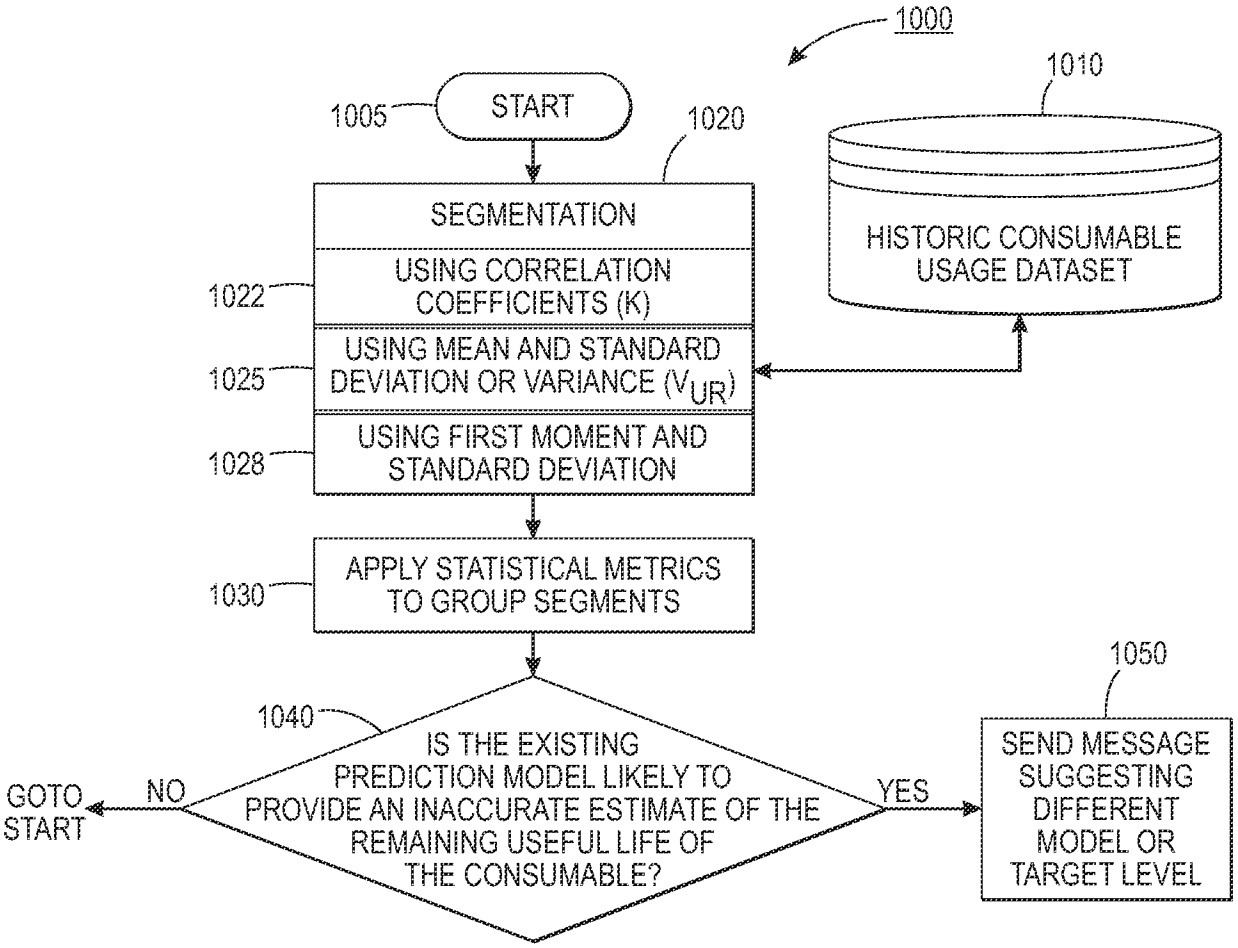
FIG. 10 is a flowchart of a method to alert a user when it is probable that a remaining life prediction models will not yield accurate results for a given time window, so that a different prediction model or an alternative shipment triggering algorithm can be employed in accordance to an embodiment.

FIG. 10 is a flowchart of method 1000 to alert a user when it is probable that a remaining life prediction models will not yield accurate results for a given time window, so that a different prediction model or an alternative shipment triggering algorithm can be employed in accordance to an embodiment. Method 1000 can be performed by a cloud computing device like database 140, a server, or a program computer like computer 202 and printer 135. Method 1000 starts with action 1005 which signals action 1020 to generate a query to transfer a portion or all of the historic consumable usage dataset to the segmentation module.

The dataset can be maintained in individual tables for device families or consumable in a data storage device like database 140. A typical query is based on the machine serial number or Printer ID, individual consumable identification (CRU-ID), a type or family of consumable identification (CRU). The query from action 1020 can take the following form:

```
source1 <- paste("select DISTINCT
```

-continued

```
        to_date(substr(t.supply_hist_tstamp,1,9))
as
            dateStamp, t.mach_sn, ",
        " \n t.part_description, t.max_capacity,
t.current_level_prefltrd,
        t.meter_value as total_impressions, ",
        " \n t.meter_value as color_impressions from ",
        database0," \n where t.mach_sn = "' ,mach_sn,"' and
        t.part_description LIKE '%" ,
        color0,"%'","\n ORDER by dateStamp",sep="")
```

In action 1020, the received dataset is processed to segment the consumables into groups. The segmentation generates a first segment 1022 using correlation coefficients (k), a second segment 1025 using mean and standard deviation or variance ($V_{ur}$), and a third segment 1028 using first moment and standard deviation. The method then proceeds to action 1030. Action 1030 applies statistical metrics to group segments (groups). to determine how the prediction accuracy of the model performs for the segment of the dataset. Control is then passed to action 1040 for further processing.

In action 1040, a determination is made to see if the existing prediction model is likely to provide an inaccurate estimate of the remaining useful life of the consumable. If the answer is no then control is sent back to the start of the process. However, if the answer is yes then control is passed to action 1050. In action 1050, a message is sent to alert a user when it is probable that remaining life prediction models will not yield accurate results for a given time window, so that a different prediction model or an alternative shipment triggering algorithm can be employed.

Figure 11:
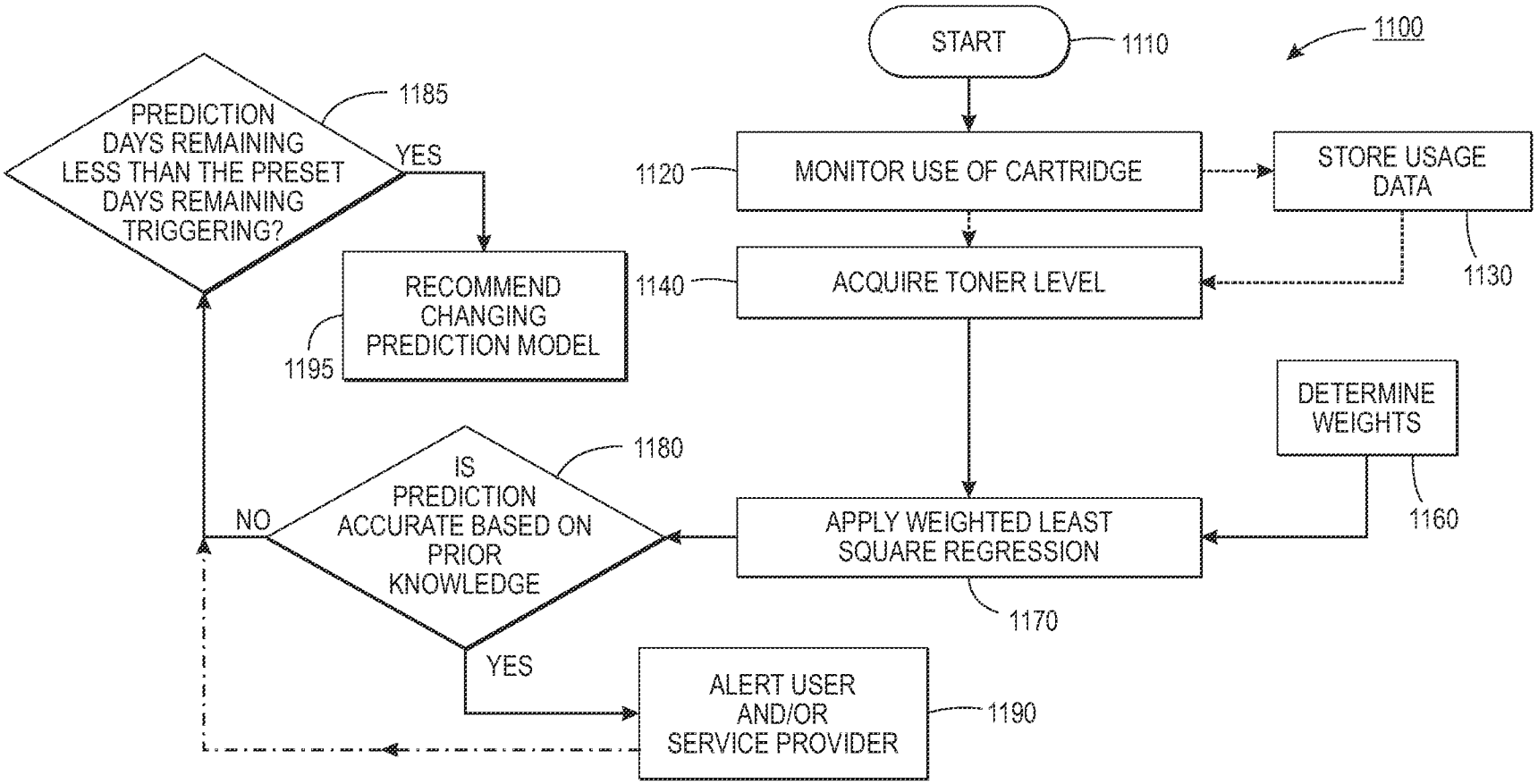
FIG. 11 is a flowchart of a method for validating a model to predict the useful life of a consumable in accordance to an embodiment.

FIG. 11 is a flowchart of a method 1100 for validating a model to predict the useful life of a consumable in accordance to an embodiment.

Actions 1110 through 1170 in method are identical to actions 810 through 870 of method 800. Action 1180 determine if the prediction accurate based prior/history knowledge and when yes then in action 1190 the user and/or service provider is alerted If the determination in action 1180 is "NO" then control is passed to action 1185 where it is determined if the prediction days remaining less than the preset days remaining triggering. If the prediction days remaining less than preset days a message is sent recommending the change of the prediction model with a better prediction model. It should be noted that action 1185 and action 1195 can be added after action 1190 to indicate that the model in place while accurate may be short of the preset days.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method to rapidly detect anomalies in measurement and/or usage which would prevent accurate estimates of supply level and of remaining useful life of a consumable in an image reproduction device, the method comprising:

selectively segmenting consumables into groups which show statistically different levels of prediction accuracy by prediction models when a prediction was given by a prediction model applied to a historic consumable usage dataset;

wherein segmenting the consumables into groups comprises determining a mean and standard deviation or variance (Vur) of a usage rate of the consumable;

wherein the prediction accuracy is a prediction error based on a difference between a predicted target day (PTD) as predicted by the prediction models and an actual target day(ATD);

applying statistical metrics to the groups which show statistically different levels of prediction accuracy for a given time window;

wherein the statistical metrics is a percentage of consumables within a predetermined range from the actual target day (ATD);

determining, from the statistical metrics of the prediction accuracy, if an employed prediction model is likely to provide an inaccurate estimate of the remaining useful life of the consumable;

wherein if it is determined that the employed prediction model is likely to provide an inaccurate estimate, then sending a message suggesting changing the employed prediction model.

2. The method in accordance to claim 1, wherein segmenting the consumables into groups comprises determining a correlation coefficients (K) between a usage of the consumable and the output of the image reproduction device.

3. The method in accordance to claim 1, wherein segmenting the consumables into groups comprises determining a first moment and a standard deviation of a predicted time when the consumable reaches end of life.

4. The method in accordance to claim 1, wherein segmenting the consumables into groups comprises determining at least one of a first moment and a standard deviation of a predicted time when the consumable reaches end of life, a correlation coefficients (K) between a usage of the consumable and the output of the image reproduction device, or a mean and standard deviation or variance (Vur) of a usage rate of the consumable.

5. A non-transitory computer readable medium encoded with computer executable instructions, which when accessed, causes a machine to perform operations comprising:

selectively segmenting consumables into groups which show statistically different levels of prediction accuracy by prediction models when a prediction was given by a prediction model applied to a historic consumable usage dataset;

wherein segmenting the consumables into groups comprises determining a mean and standard deviation or variance (Vur) of a usage rate of the consumable;

wherein the prediction accuracy is a prediction error based on a difference between a predicted target day (PTD) as predicted by the prediction models and an actual target day(ATD);

applying statistical metrics to the groups which show statistically different levels of prediction accuracy a given time window;

wherein the statistical metrics is a percentage of consumables within a predetermined range from the actual target day (ATD);

determining, from the statistical metrics of the prediction accuracy, if an employed prediction model is likely to provide an inaccurate estimate of the remaining useful life of the consumable;

wherein if it is determined that the employed prediction model is likely to provide an inaccurate estimate, then sending a message suggesting changing the employed prediction model.

6. The method in accordance to claim 1, wherein segmenting the consumables into groups comprises determining a correlation coefficients (K) between a usage of the consumable and the output of an image reproduction device.

7. The non-transitory computer readable medium encoded with computer executable instructions in accordance to claim 5, wherein segmenting the consumables into groups comprises determining a first moment and a standard deviation of a predicted time when the consumable reaches end of life.

8. The non-transitory computer readable medium encoded with computer executable instructions in accordance to claim 5, wherein segmenting the consumables into groups comprises determining at least one of a first moment and a standard deviation of a predicted time when the consumable reaches end of life, a correlation coefficients (K) between a usage of the consumable and the output of an image reproduction device, or a mean and standard deviation or variance (Vur) of a usage rate of the consumable.

9. based consumable management platform, comprising:

a database operable to store information associated with at least one replaceable toner cartridge, wherein the stored information includes daily toner cartridge level data from replaceable cartridges, wherein the database is further operable to rapidly detect anomalies in measurement and/or usage which would prevent accurate estimates of a remaining life of a replaceable cartridge and to alert a user or a service/maintenance provider that an anomaly has been detected by:

selectively segmenting replaceable toner cartridges into groups which show statistically different levels of prediction accuracy when a prediction was given by a prediction model applied to a historic replaceable toner cartridge usage dataset;

wherein segmenting the consumables into groups comprises determining a mean and standard deviation or variance (Vur) of a usage rate of the consumable;

wherein segmenting the replaceable toner cartridges into groups comprise determining a correlation coefficients (K) between a usage of the replaceable toner cartridge and the output of an image reproduction device;

applying statistical metrics to the groups which show statistically different levels of prediction accuracy to identify when it is probable that a remaining life prediction models will not yield accurate results for a given time window, so that a different prediction model or an alternative shipment triggering algorithm can be employed;

wherein the statistical metrics is a percentage of consumables within a predetermined range from an actual target day (ATD);

determining, from the statistical metrics of the prediction accuracy, if an employed prediction model is likely to provide an inaccurate estimate of the remaining useful life of the consumable;

wherein if it is determined that the employed prediction model is likely to provide an inaccurate estimate, then sending a message suggesting changing the employed prediction model.

10. The dynamic cloud based consumable management platform in accordance to claim 9, wherein segmenting the replaceable toner cartridges into groups comprises determining at least one of a first moment and a standard deviation of a predicted time when the replaceable toner cartridge reaches end of life, a correlation coefficients (K) between a usage of the replaceable toner cartridge and the output of an image reproduction device, or a mean and standard deviation or variance (Vur) of a usage rate of the replaceable toner cartridge.

11. The dynamic cloud based consumable management platform in accordance to claim 9, wherein the prediction accuracy is a prediction error based on a difference between a predicted target day (PTD) as predicted by the prediction model and the actual target day (ATD).

12. The dynamic cloud based consumable management platform in accordance to claim 11, wherein the statistical metrics is a percentage of replaceable toner cartridges within a predetermined range from the predicted target day.

* * * * *